US006701648B2

(12) United States Patent
Battaglia

(10) Patent No.: US 6,701,648 B2
(45) Date of Patent: Mar. 9, 2004

(54) ADJUSTABLY LOCKING STETHOSCOPE IDENTIFICATION TAG

(75) Inventor: Anthony J. Battaglia, Coraopolis, PA (US)

(73) Assignee: Pocket Nurse Enterprises, Inc., Coraopolis, PA (US)

( * ) Notice: Subject to any disclaimer, the term of this patent is extended or adjusted under 35 U.S.C. 154(b) by 0 days.

(21) Appl. No.: 09/990,632

(22) Filed: Nov. 21, 2001

(65) Prior Publication Data

US 2003/0093932 A1 May 22, 2003

(51) Int. Cl.[7] ..... G09F 3/00; G09F 3/16

(52) U.S. Cl. ..... 40/299.01; 40/666; 24/3.13; 24/714.1

(58) Field of Search ..... 40/1.5, 299.01, 40/301, 316, 706, 660, 707, 666, 781; 24/3.13, 122.6, 712.1, 714.1; 181/131

(56) References Cited

U.S. PATENT DOCUMENTS 3,344,543 A * 10/1967 Griffin et al. ..... 40/1.5
4,344,240 A * 8/1982 Schiller ..... 40/662
4,497,124 A 2/1985 Olive
4,949,483 A * 8/1990 Dobson et al. ..... 40/740
5,012,601 A * 5/1991 Garland et al. ..... 40/781
5,016,368 A * 5/1991 Cassata ..... 40/666
D321,913 S 11/1991 Wolff
5,313,721 A * 5/1994 Filden ..... 40/1.6
D381,366 S * 7/1997 Rossini et al. ..... D20/22
D381,367 S * 7/1997 Rashman ..... D20/22
D403,708 S 1/1999 Wolff
D407,453 S 3/1999 Rashman
6,067,659 A * 5/2000 Reichle ..... 2/239
6,158,096 A * 12/2000 Bar ..... 24/712.9
6,269,573 B1 * 8/2001 Najmi ..... 40/666
6,497,062 B1 * 12/2002 Koopman et al. ..... 40/301

* cited by examiner

*Primary Examiner*—Brian K. Green
(74) *Attorney, Agent, or Firm*—Webb Ziesenheim Logsdon Orkin & Hanson, P.C.

(57) ABSTRACT

An adjustably locking stethoscope identification tag having a first body and a second body, the first body defining a first surface and a second surface, the second body defining a third surface and a fourth surface, a first leg positioned adjacent to the second surface of the first body and extending in a direction away from the second surface of the first body, and a first leg retainer positioned adjacent to the third surface of the second body and extending in a direction away from the third surface of the second body, wherein a space defined between the first body and the second body is increased by moving the first body in a direction away from the second body and is decreased by moving the first body in a direction toward the second body.

13 Claims, 2 Drawing Sheets

ADJUSTABLY LOCKING STETHOSCOPE IDENTIFICATION TAG

BACKGROUND OF THE INVENTION

1. Field of the Invention

The present invention generally relates to identification tags and, more particularly, to an adjustably locking identification tag configured to be used with a stethoscope.

2. Description of Related Art

Stethoscope tags are commonly attached to hollow tubing of a stethoscope and are used as a form of identification or an advertising medium. In general, the stethoscope tag is positioned adjacent or otherwise attached to hollow tubing which connects ear pieces and the diaphragm of a stethoscope. Indicia positioned on the stethoscope tag can indicate personal information or an advertising source. U.S. Pat. No. 4,497,124 to Olive (hereinafter "the Olive patent") and U.S. Design Pat. No. 403,708 to Wolff (hereinafter "the Wolff I patent"), U.S. Pat. No. 321,913 to Wolff (hereinafter "the Wolff II patent"), and U.S. Pat. No. 407,453 to Rashman (hereinafter "the Rashman patent") each disclose various stethoscope tags.

The Olive patent discloses a stethoscope identification tag having two pieces which are snap-fitted together near a "Y" junction of hollow stethoscope tubing. The Wolff I, Wolff II, and Rashman patents each show a stethoscope identification tag which attaches to only one branch of hollow tubing located between an ear piece and the diaphragm.

The prior art stethoscope identification tags discussed above are not designed to adjustably adapt to varying thicknesses of stethoscope hollow tubing. For this reason, a need exists for an adjustably locking stethoscope tag.

SUMMARY OF THE INVENTION

To help solve the deficiencies associated with the prior art, the present invention is directed toward an adjustably locking stethoscope identification tag which may include a first body and a second body. The first body preferably defines a first surface and a second surface and the second body preferably defines a third surface and a fourth surface. A first leg may be positioned adjacent to the second surface of the first body and the first leg may extend in a direction away from the second surface of the first body. A first leg retainer may be positioned adjacent to the third surface of the second body and the first leg retainer may extend in a direction away from the third surface of the second body. A space defined between the first body and the second body may be increased by moving the first body in a direction away from the second body and may be decreased by moving the first body in a direction toward the second body.

A second leg may extend in a substantially perpendicular direction away from the second surface of the first body and a second leg retainer may extend in a substantially perpendicular direction away from the third surface, wherein the second leg adjustably engages the second leg retainer. A first tab and a second tab are preferably spaced apart from one another along the first leg length of the first leg and preferably protrude in the same direction away from the first leg. A first lip may be positioned in the first leg retainer orifice defined by the leg retainer, wherein the first tab and the second tab are each capable of releasably engaging the first lip.

A stethoscope having a diaphragm, a Y-shaped hollow tubing having a trunk, a first ear portion, and a second ear portion, may also be provided. The trunk preferably has a first trunk end and a second trunk end, the first trunk end connected to the diaphragm and the second trunk end connected to both the first ear and the second ear at an intersection of the second trunk end, the first ear portion, and the second ear portion.

The adjustably locking identification tag according to the present invention preferably has two or more tabs which extend away from a leg. These tabs engagingly lock a corresponding lip, which makes the present invention adjustable, locking, and designed to adapt to varying thicknesses of stethoscope hollow tubing.

These and other advantages of the present invention will be clarified in the description of the preferred embodiment taken together with the attached drawings in which like reference numerals represent like elements throughout.

DESCRIPTION OF THE PREFERRED EMBODIMENT(S)

Figure 3:
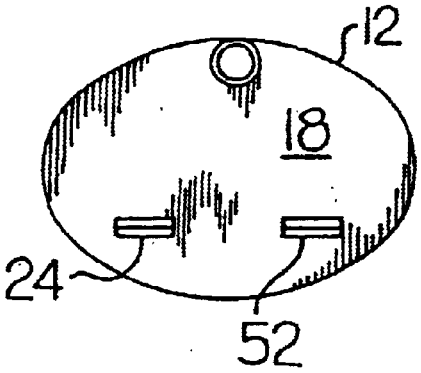
FIG. 3 is a first end view of a first body of the adjustable stethoscope tag shown in FIGS. 1 and 2.
Figure 4:
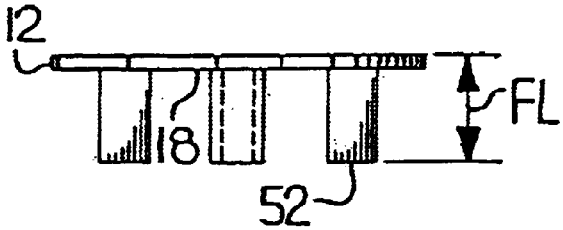
FIG. 4 is a top view of the first body shown in FIG. 3.
Figure 7:
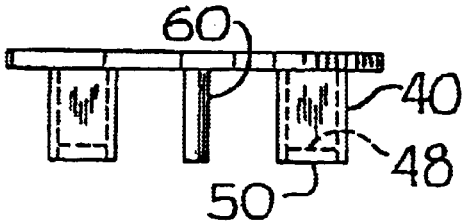
FIG. 7 is a top view of the second body shown in FIG. 6.
Figure 6:
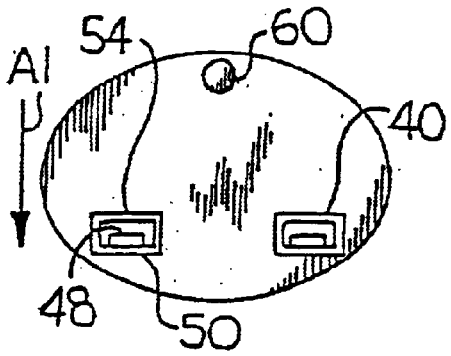
FIG. 6 is a first end view of a second body of the adjustable stethoscope tag shown in FIGS. 1 and 2.
Figure 5:
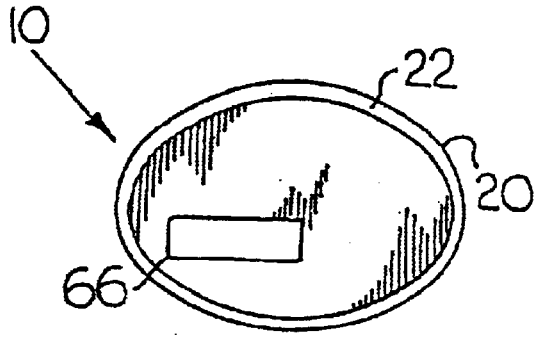
FIG. 5 is a second end view of the first body shown in FIGS. 3 and 4.

An adjustable stethoscope tag 10 according to the present invention is shown in FIGS. 1, 2, 5, and 8. FIGS. 3–5 show a first body 12 of the adjustable stethoscope tag 10, and FIGS. 6 and 7 show a second body 14 of the adjustable stethoscope tag 10.

Figure 1:
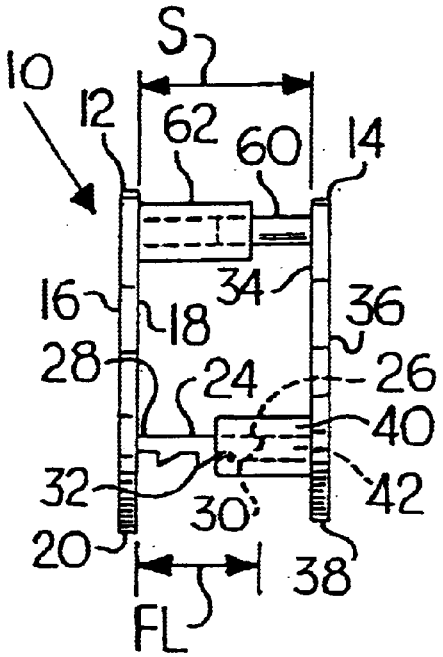
FIG. 1 is a side view of an adjustable stethoscope tag according to the present invention.
Figure 2:
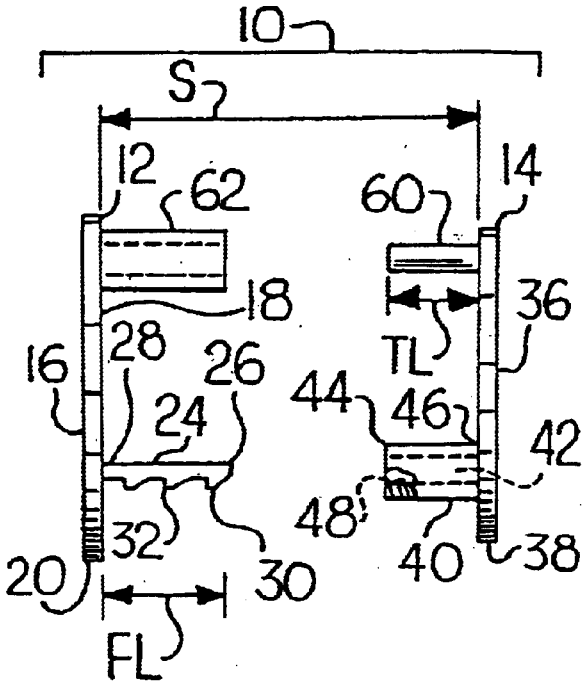
FIG. 2 is an exploded view of the adjustable stethoscope tag shown in FIG. 1.

As shown in FIGS. 1 and 2, the adjustable stethoscope tag 10 according to the present invention generally includes a first body 12 and a second body 14. As shown in greater detail in FIGS. 1 and 2, the first body 12 preferably defines a planar, oval shape, a first surface 16, a second surface 18, and a first peripheral edge 20. Referring briefly to FIG. 5, a first ridge 22 is raised with respect to the first surface 16 of the first body 12, circumscribes the first surface 16 of the first body 12, and is positioned adjacent to the first peripheral edge 20 of the first body 12.

Referring again to FIGS. 1 and 2, a first leg 24 extends in a substantially perpendicular direction away from the second surface 18 of the first body 12. The first leg 24 has a first leg end 26, a second leg end 28, and a first leg length FL. The first leg 24 further defines a first tab 30 that extends away from the first leg 24 and a second tab 32 which also extends away from the first leg 24. The first tab 30 is positioned adjacent to the first leg end 26 of the first leg 24, and the second tab 32 is spaced away from the first tab 30 in a direction toward the second leg end 28 of the first leg 24. In a preferred embodiment, the first tab 30 and the second tab 32 extend away from the first leg 24 in the same direction.

With continuing reference to FIGS. 1 and 2, the second body 14 defines a third surface 34, a fourth surface 36, and a second peripheral edge 38. The second body 14 also defines a second ridge which is similar to the first ridge 22 shown in FIG. 5.

Referring once again to FIGS. 1 and 2, a first leg retainer 40 extends in a substantially perpendicular direction away from the third surface 34 of the second body 14. As shown in FIG. 2, the first leg retainer 40 defines a first leg retainer orifice 42 having a first orifice end 44 and a second orifice end 46. The first orifice end (44) is open and the second orifice end (46) is closed by the third surface (34) of the second body (14). In the preferred embodiment, a first lip 48 is provided adjacent to the first orifice end 44 of the first leg retainer orifice 42, with the first lip 48 extending into the first leg retainer orifice 42. As shown in FIGS. 1 and 2, the first leg retainer 40 may be a fully enclosed structure. Alternatively, as shown in FIGS. 6 and 7, a portion 50 of the first leg retainer 40, which includes the first lip 48, may be separated from the remaining portions of the first leg retainer 40, so that the portion 50 can be pulled in the A1 direction. In the configuration shown in FIGS. 6 and 7, the portion 50 should be made from a sturdy yet flexible material, such as plastic. Otherwise, the first body 12, second body 14, the first leg 24, and first leg retainer 40 can also be made from plastic or other suitable material.

In an assembled configuration shown in FIG. 1 or in the exploded view shown in FIG. 2, the third surface 34 of the second body 14 is positioned substantially parallel to the second surface 18 of the first body 12, with the first leg retainer orifice 42 receiving a first leg length FL of the first leg 24. The first tab 30 of the first leg 24 releasably engages the first lip 48 positioned in the first leg retainer orifice 42. A space S, as measured between a first imaginary plane lying coincident with the second surface 18 of the first body 12 and a second imaginary plane lying coincident with the third surface 34 of the second body 14, can be decreased by inserting a greater amount of the first leg length FL of the first leg 24 into the first leg retainer orifice 42 defined by the first leg retainer 40, such that the second tab 32 releasably engages the first lip 48. Conversely, as shown in FIGS. 1 and 2 the space S between the first body 12 and the second body 14 can then be increased by pulling the portion 50 of the first leg retainer 40 in the A1 direction and moving the first body 12 in a direction away from the second body 14 such that the first lip 48 ceases to engage the second tab 32 and instead engages the first tab 30. If the first leg retainer 40 is integrally formed and does not have the first lip 48 provided on a separate portion 50, the present invention is only adjustable in one direction.

As shown in FIGS. 3 and 4, a second leg 52, which is similar and preferably identical to the first leg 24, may also be provided. Like the first leg 24, the second leg 52 is positioned adjacent to the second surface 18 of the first body 12, with the second leg 52 also extending in a substantially perpendicular direction away from the second surface 18 of the first body 12. The second leg 52 has a second leg length substantially equal to the first leg length FL and further defines a third tab and a fourth tab.

With reference to FIGS. 5 and 6, if a second leg 52 is provided, a second leg retainer 54 on the third surface 34 of the second body 14 is also provided. The second leg retainer 54 extends in a substantially perpendicular direction away from the third surface 34 of the second body 14 and is positioned directly opposite to the second leg 54 shown in FIGS. 3 and 4. Like the first leg retainer 40, the second leg retainer 54 defines a second leg retainer orifice 56 and a second lip 58. The operation of the second leg 52 and the second leg retainer 54 is similar to the operation of the first leg 24 and the first leg retainer 40.

As shown in FIGS. 1 and 2, a third leg 60 can also be provided. In the preferred embodiment, the third leg 60 extends in a substantially perpendicular direction away from the third surface 34 of the second body 14, with the third leg 60 having a third leg length TL substantially equal to the first leg length FL and the second leg length shown in FIG. 4. Referring again to FIGS. 1 and 2, the third leg 60 preferably has a smooth outer surface and does not define tabs. If a third leg 60 is provided, a third leg retainer 62 extends in a substantially perpendicular direction away from the second surface 14 of the first body 12. The third leg retainer 62 defines a third leg retainer orifice 64 and is positioned directly opposite to the third leg 60 provided on the second body 14. The third leg 60 engages with the third leg retainer orifice 64.

As shown in FIG. 5, indicia 66 may be positioned on the first surface 16 of the first body 12 or on the fourth surface 36 of the second body 14, and the ridge 22 may provide a border for decals.

Figure 8:
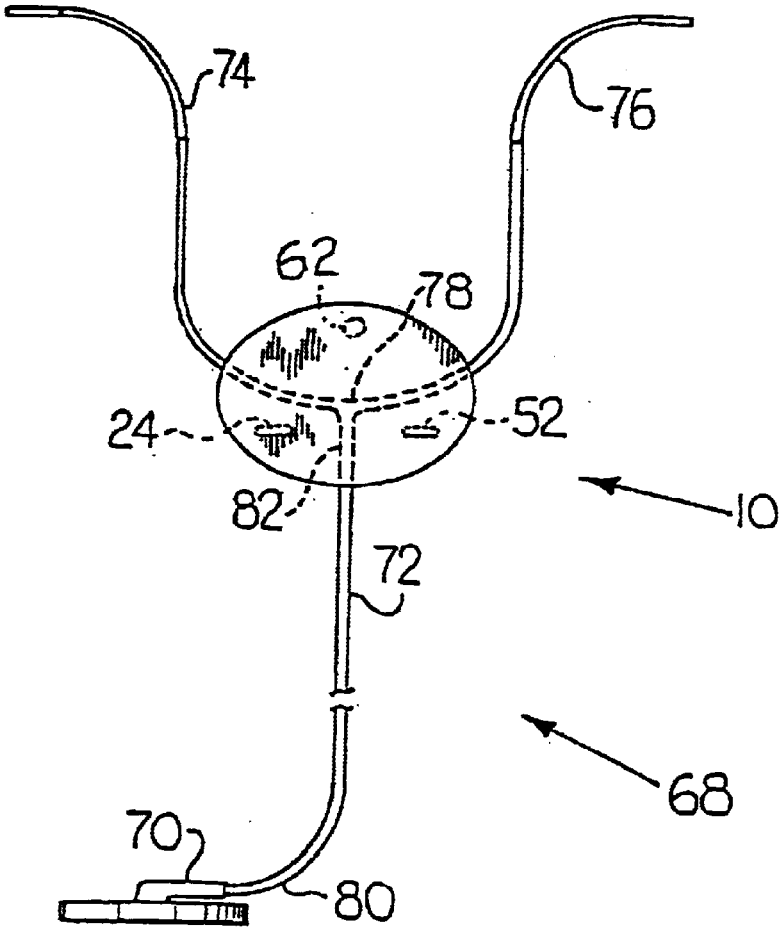
FIG. 8 is a second end view of an adjustable stethoscope tag shown in FIG. 1 removably connected to hollow tubing of a stethoscope.

As shown in FIG. 8, the stethoscope tag 10 according to the present invention is adjustably attached to a stethoscope 68 or other suitable device. The stethoscope 68 generally includes a diaphragm 70 and a Y-shaped hollow tubing having a trunk 72, a first ear portion 74, a second ear portion 76, and an intersection 78 between the trunk 72 and the two ears portions 74, 76. The trunk 72 has a first trunk end 80 and a second trunk end 82, with the first trunk end 80 connected to the diaphragm 70 and each ear portion 74, 76 fluidly connected to the second trunk end 82 of the trunk 72 at the intersection 78. In this arrangement, the trunk 72 of the hollow tubing passes between the first leg 24 and the second leg 52, the first ear portion 74 passes between the first leg 24 and the third leg 60, and the second ear portion 76 passes between the second leg 52 and the third leg 60.

Because tubing diameters can increase or decrease depending on the manufacturer, the present invention allows the first body 12 and the second body 14 to be adjustably spaced from one another to accommodate varying thicknesses of the hollow stethoscope tubing.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. An adjustable stethoscope identification tag comprising: a first body having a first surface and a second surface, the first body having a first leg extending in a substantially perpendicular direction away from the second surface of the first body, the first leg having a first tab and second tab spaced apart from one another along a first leg length of the first leg, wherein the first tab and the second tab protrude in the same direction away from the first leg; and a second body having a third surface and a fourth surface, the second body having a first leg retainer extending in a substantially perpendicular direction away from the third surface of the second body, the first leg retainer defining a first leg retainer orifice having a first orifice end and a second orifice end, wherein the first orifice end is open and the second orifice end is closed by the third surface of the second body, the first leg retaining orifice having a first lip positioned in the orifice, wherein the first tab and the second tab are each capable of releasably engaging the first lip, with the first body adjustable with respect to the second body such that a space defined between the first body and the second body is increased by moving the first body in a direction away from the second body and is decreased by moving the first body in a direction toward the second body.

2. The adjustable stethoscope identification tag as claimed in claim 1, wherein the first body further defines a first peripheral edge and a first ridge, with the first ridge raised with respect to the first surface of the first body and positioned adjacent to the first peripheral edge of the first body.

3. The adjustable stethoscope identification tag as claimed in claim 2, wherein the second body further defines a second peripheral edge and a second ridge, with the second ridge raised with respect to the fourth surface of the second body and positioned adjacent to the second peripheral edge of the second body.

4. The adjustable stethoscope identification tag as claimed in claim 1, further comprising a second leg extending in a substantially perpendicular direction away from the second surface of the first body and a second leg retainer extending in a substantially perpendicular direction away from the third surface, wherein the second leg adjustably engages the second leg retainer.

5. The adjustable stethoscope identification tag as claimed in claim 4, further comprising a third leg extending in a substantially perpendicular direction away from the second surface of the first body and a third leg retainer extending in a substantially perpendicular direction away from the third surface, wherein the third leg adjustably engages the third leg retainer.

6. An adjustable stethoscope identification tag comprising:

a first body and a second body, the first body defining a first surface and a second surface, the second body defining a third surface and a fourth surface;

a first leg positioned adjacent to the second surface of the first body and extending in a direction away from the second surface of the first body;

a first leg retainer positioned adjacent to the third surface of the second body and extending in a direction away from the third surface of the second body;

a first tab and a second tab spaced apart from one another along a first leg length of the first leg and the first tab and the second tab protruding in the same direction away from the first leg; and a first lip positioned in a first leg retainer orifice defined by the first leg retainer, the first leg retainer orifice having a first orifice end and a second orifice end, wherein the first orifice end is open and the second orifice end is closed by the third surface of the second body, wherein a space defined between the first body and the second body is increased by moving the first body in a direction away from the second body and is decreased by moving the first body in a direction toward the second body, and wherein the first tab and the second tab are each capable of releasably engaging the first lip.

7. The adjustable stethoscope identification tag as claimed in claim 6, further comprising a second leg extending in a substantially perpendicular direction away from the second surface of the first body and a second leg retainer extending in a substantially perpendicular direction away from the third surface, wherein the second leg adjustably engages the second leg retainer.

8. A stethoscope comprising:

a diaphragm;

a Y-shaped hollow tubing having a trunk, a first ear portion, and a second ear portion, the trunk having a first trunk end and a second trunk end, the first trunk end connected to the diaphragm and the second trunk end connected to both the first ear portion and the second ear portion at an intersection of the second trunk end, the first ear portion, and the second ear portion;

an identification tag positioned at the intersection of the trunk, the first ear portion, and the second ear portion of the Y-shaped hollow tubing, the identification tag comprising a first body and a second body, the first body defines a first surface and a second surface, the second body defines a third surface and a fourth surface;

a first leg extending in a substantially perpendicular direction away from the second surface of the first body and a first leg retainer extending in a substantially perpendicular direction away from the third surface; and a first tab and a second tab spaced apart from one another along a first leg length of the first leg and the first tab and the second tab protruding in the same direction away from the first leg, wherein the Y-shaped hollow tubing passes between the first body and the second body, and the first body is adjustable with respect to the second body such that a space defined between the first body and the second body is increased by moving the first body in a direction away from the second body and is decreased by moving the first body in a direction toward the second body.

9. The stethoscope as claimed in claim 8, further comprising a second leg extending in a substantially perpendicular direction away from the second surface of the first body and a second leg retainer extending in a substantially perpendicular direction away from the third surface, wherein the second leg adjustably engages the second leg retainer.

10. The stethoscope as claimed in claim 9, further comprising a third leg extending in a substantially perpendicular direction away from the second surface of the first body and a third leg retainer extending in a substantially perpendicular direction away from the third surface, wherein the third leg adjustably engages the third leg retainer.

11. The stethoscope as claimed in claim 8, further comprising a first lip positioned in a first leg retainer orifice defined by the leg retainer, wherein the first tab and the second tab are each capable of releasably engaging the first lip.

12. The stethoscope as claimed in claim 8, wherein the first body further defines a first peripheral edge and a first ridge, the first ridge raised with respect to the first surface of the first body and positioned adjacent to the first peripheral edge of the first body.

13. The stethoscope as claimed in claim 8, wherein the second body further defines a second peripheral edge and a second ridge, the second ridge is raised with respect to the fourth surface of the second body and positioned adjacent to the second peripheral edge of the second body.

* * * * *